US005637878A

United States Patent [19]

Herer et al.

[11] Patent Number: 5,637,878

[45] Date of Patent: Jun. 10, 1997

[54] PROCESS FOR IRRADIATING GEMSTONES

[75] Inventors: Arnold S. Herer, Ho Pewell Township; Thomas M. Knobel, Morris Plains; Gregory J. Robb, Lawrenceville, all of N.J.

[73] Assignee: E-Beam Corporation, Cranbury, N.J.

[21] Appl. No.: 383,190

[22] Filed: Feb. 3, 1995

(Under 37 CFR 1.47)

[51] Int. Cl.[6] ..... G21K 5/00

[52] U.S. Cl. ..... 250/492.3

[58] Field of Search ..... 250/492.1, 492.3; 378/64; 204/157.15, 157.44; 430/4

[56] References Cited

U.S. PATENT DOCUMENTS

| | | | |
|---|---|---|---|
| 4,749,869 | 6/1988 | Founrier | 250/492.1 |
| 5,084,909 | 1/1992 | Pollak | 250/492.1 |
| 5,477,055 | 12/1995 | Skold et al. | 250/492.1 |

*Primary Examiner*—Jack I. Berman
*Assistant Examiner*—Kiet T. Nguyen
*Attorney, Agent, or Firm*—John Lezdey

[57] ABSTRACT

A method the electron-beam irradiation of gemstones for uniform color enhancement requiring an electron-beam source having a capacity of 500 kW generating energy of between 3 MeV to 50 MeV. The method requires the gemstones to be moved in and out of the electron-beam path with the electron-beam source also being oscillated but in a direction ninety degrees opposed to the gemstones. Cooling means for the gemstones are also required to prevent heat stress cracking. Gemstones such as beryl, diamonds, quartz, sapphires, tourmaline, dark pearls and other minerals are suitable. More particularly the method relates to the treatment of topaz.

8 Claims, 1 Drawing Sheet

PROCESS FOR IRRADIATING GEMSTONES

FIELD OF THE INVENTION

The present invention relates to electron-beam irradiation processes for the color enhancement of gemstones. More particularly, there is provided a process for reducing the time required for irradiating topaz.

DESCRIPTION OF THE PRIOR ART

It has long been known that high energy irradiation of certain gemstones, glasses and plastics by sub-atomic particles produces changes in properties including the color characteristics of these materials. However, the results of such sub-atomic particle irradiation are not predictable for any specific material or type of radiation. For example, when colorless topaz is subjected to neutron bombardment the gemstones result in a very dark color which sometimes has an undesirable gray or green appearance.

Topaz is a mineral aluminum silicate [$Al_2F_2SiO_4$ or $Al_2SiO_4$ (F,OH)] naturally occurring usually in white orthorhombic translucent or transparent crystals or in white translucent masses. However, it also occurs naturally in a spectrum of colors, i.e., blue, yellow, green, orange, reddish, pink or gold. Generally gamma rays generated by the cobalt-60 isotope, high energy electrons from linear accelerators and neutrons from nuclear reactors are used to alter the color of topaz.

U.S. Pat. No. 4,749,869 issued to Richard Fournier discloses a method of treating topaz gemstones which are colorless or pale-colored to alter their color to a bright blue shade, which process involves neutron then electron irradiation steps. More specifically the method comprises as a first step irradiating colorless or pale-colored topaz with neutrons to produce some color and then the second step comprises irradiating the neutron irradiated topaz stone at an exposure level, that is, from about 1,000 to 10,000 megarads, until the desired bright blue color is obtained. In some cases the topaz tones may require yet an additional step after the irradiation, i.e., a heating step at a temperature from about 175° to 300° C. for about one to six hours to produce the desired color.

U.S. Pat. No. 5,084,909 issued to Polk relates to another multi-step method of processing gemstones for color enhancement comprising heating the gemstone at a temperature between 150° and 1,100° C. for about fifteen minutes to fifty hours and then irradiating the gemstone with gamma rap to give a total exposure of between about 200 and 10,000 megarads. In one embodiment the process includes the step of heating the gemstones as an after treatment to gamma ray irradiation at a temperature of between 160° and 1,100° C. for 15 minutes to 50 hours. In the case of topaz, another embodiment includes the step of irradiating the topaz stone with neutrons preceding the heating step.

The theory for the color change, specifically where the colorless topaz stone turns to a blue color, is not clearly understood. Stephenson, "introduction to Nuclear Engineering" pp 222, 256 and 350, noted in U.S. Pat. No. 4,749,869, proposes that it is merely a displacement of electrons from one part of the material to another part within the crystal lattice to form the color or "F" center thereby changing its isotropy and color.

Another explanation for this color altering phenomenon is proffered in U.S. Pat. No. 5,084,909 where it is proposed that the presence of phosphorous as an impurity allows the formation of color centers by irradiation strong enough to displace the electrons. Further, the disclosure postulates that the silicon is transformed into phosphorous by neutron radiation. This in situ formation of phosphorous can be attained through irradiation with protons, neutrons or other high energy sub-atomic particles.

The major disadvantages of the processes described in the above cites patents is that each requires a series of process steps with each step carefully monitored to prevent over irradiation or overheating to prevent cracking or some interaction within the crystal lattice to form undesirable tints. Therefore, there exists a need to provide an improved method for enhancing the color of gemstones which is more efficient and yields a uniform product.

SUMMARY OF THE INVENTION

According to the present invention there is provided a method for the color enhancement of gemstones by very intense electron-beam radiation comprising the steps of:

placing the gemstones in an oscillating means provided with coolant means;

circulating a coolant through said coolant means;

initiating an oscillating motion along a horizontal y-axis in said oscillating means;

directing an oscillating electron-beam produced by an electron-beam source having the power of about 10 kW to about 500 kW onto the gemstones and wherein the oscillating motion is along a horizontal z-axis;

maintaining the circulation of coolant through said coolant means until the gemstones are cooled to ambient temperature; and removing uniformly colored gemstones.

Preferably, the gemstones are irradiated at between about 3 MeV to 5 MeV to provide a total dosage of between about 4 to 25 gigarads for a period of about 15 to 500 hours.

More particularly, the method relates to the electron-beam irradiation of topaz stones for color enhancement comprising the steps of:

placing the topaz stones in an oscillating means provided with coolant means;

circulating a coolant through said coolant means;

initiating an oscillating motion along a horizontal y-axis in said oscillating means;

directing an oscillating electron-beam produced by an electron-beam source have the power of 50 kW at between about 3 MeV to 5 MeV to provide a dosage of between 4 to 25 gigarads for a period of about 24 hours onto the topaz stones and wherein the oscillating motion is along a horizontal z-axis.

maintaining the circulation of coolant through said coolant means until the topaz stones are cooled to ambient temperatures; and removing uniformly colored topaz stones.

It is therefore an object of the present invention to provide a method whereby any form of topaz can be treated to produce a very desirable colored product devoid of cracking and resident electronic discharge.

It is another object of the present invention to eliminate undesirable tints in neutron irradiated topaz and avoid stress cracking during radiation.

A further object of the present invention is to provide an economical and efficient method for color enhancement of gemstones by electron-beam radiation.

A still further object of the present invention is to simplify the method by eliminating additional process steps such as heating and irradiation using different sub-atomic particles.

It is a yet further object of the invention to provide a method of irradiating topaz in a manner to reduce the time required to achieve a desirable color.

DETAILED DESCRIPTION OF THE PREFERRED EMBODIMENTS

Figure 1:
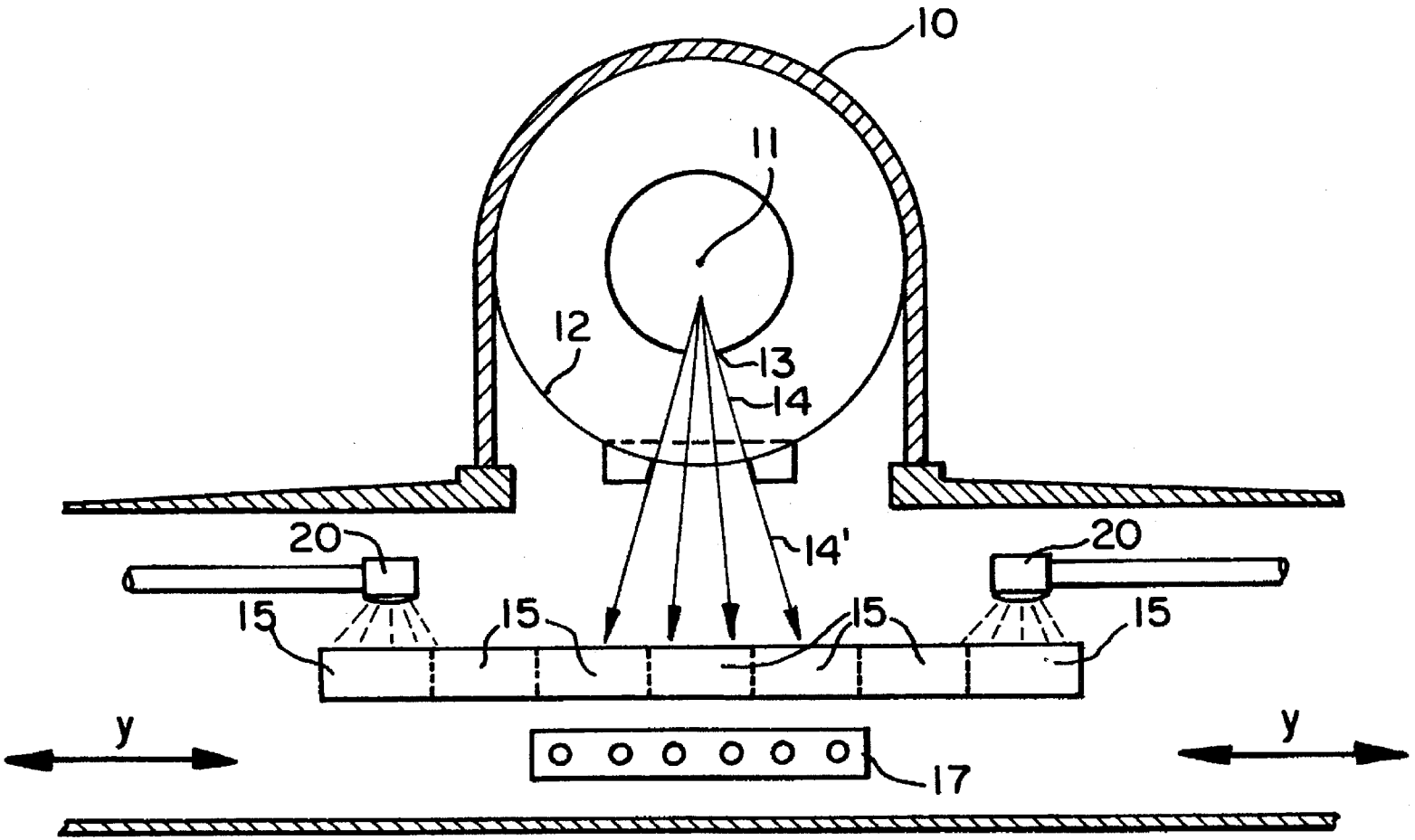
FIG. 1 is a schematic of the preferred electron-beam irradiation system.

According to the present invention any scanning or curtain electron-beam generator having a capacity of 500 kW generating energy of between 3 MeV to 50 MeV can be used in practicing the invention. Electron-beam units of about 10 kW to about 500 kW are suitable. In a preferred embodiment, referring to FIG. 1, an electron-beam generator 10 of about 50 kW capacity and generating energy of about 5 MeV is utilized. Electrons from a source 11 in a vacuum chamber 12 emerge from a grid 13 and are accelerated across a vacuum gap. The electron-beam 14 generates scattered beams $\mathbf{14}^1$ to irradiate gemstones (not shown) in trays 15 on an oscillating means 16. A cooling means 17 forces a coolant, preferably a fluid such as water through trays 15. In another embodiment spraying mechanisms 20 may be used to spray a cooling fluid onto the gemstones from above.

In accordance with an embodiment of this invention, topaz stones are placed onto trays 15 which are generally manufactured from metal, preferably aluminum and which measure about 48×8×1 inches.

The topaz stones are placed into the trays 15 to a depth of about ½ inch. The trays are placed onto the oscillator 16 and the circulation of coolant through the coolant means 17 is begun. The coolant may be recirculated through the system. Initiating an oscillating motion along a horizontal y-axis at a rate of about 5 to 20 feet per minute. Then directing electron-beam radiation produced by an electron-beam generator 10 having a power of about 50 kW at about 5 MeV to provide a total dosage of between about 4 to about 25 gigarads over a period of 24 hours.

The electron-beam generator 10 also oscillates along the z-axis, i.e., a ninety degree displacement over the oscillating means 16 to provide uniform coverage over the entire topaz mass. The rate of oscillation is preferably about 1 to 4 feet per second. The oscillation of both the electron-beam generator 10 and the oscillating tray holder 16 permits a portion of the topaz mass to avoid electron bombardment momentarily and enables the topaz mass to cool.

The rate of oscillation of the electron-beam generator 10 and the oscillating means 16 is not critical and varies with the type and size of stones as well as the power utilized. However, the oscillation should be such as to provide a uniform irradiation of the gemstones.

The circulation of coolant is continued through the coolant means until the gemstones reach ambient temperature and removing the uniformly colored blue topaz devoid of stress cracking and having less electronic discharge. Any undesirable or extraneous shades of color are eliminated.

The present invention adds or enhances the color of topaz from any and all sources and all forms of topaz including but not limited to rough and preformed stones, carved stones, polished and cut stones, as well as, previously irradiated topaz by sub-atomic particles. For example, irradiated topaz from prior art processes may yield greenish-blue or greenish-yellow blue or brown stones. The instant process will alter these undesirable tints and produce a more desirable product. Furthermore, neutron treated stones are susceptible to cracking and more sensitive to heat and electronic discharge. The process of the present invention avoids these defects.

Preferably the size of the topaz ranges from 0.2 to 100 carats.

The process of the present invention also can enhance the properties of other gemstones, such as diamonds, beryl, quartz, tourmaline, sapphires, dark pearls and other minerals by uniformly increasing their color intensity, avoiding stress cracking and reducing the amount of residual radiation induced by other methods.

The process can be operated more economically thus other devices capable of generating electrons such as primary linear accelerators, Van de Graaff generators and betatrons and other devices which are considered too expensive for the treatment of gemstones.

It should be clearly understood that certain obvious modifications will occur to those skilled in the art to which this invention pertains. However, such obvious modifications are intended to be within the scope and purview of the present invention herein, and the outer boundaries of the scope of the instant invention are intended to be limited and determined only by the scope of the claims appended hereto.

What is claimed is:

1. A method for the electron-beam irradiation of gemstones for color enhancement comprising the steps of:

placing the gemstones in an oscillating means provided with coolant means;

circulating a coolant through said coolant means;

initiating an oscillating motion along a horizontal y-axis in said oscillating means;

directing an oscillating electron-beam produced by an electron-beam source having the power of about 10 kW to about 500 kW onto the gemstones and wherein the oscillating electron beam is along a z-axis;

maintaining the circulation of coolant through said coolant means until the gemstones are cooled to ambient temperature; and removing uniformly colored gemstones.

2. The method of claim 1 wherein said gemstones are selected from diamonds, beryl, quartz, tourmaline, sapphire, and dark pearls.

3. The method of claim 1 wherein said gemstone is topaz.

4. The method of claim 1 wherein said electron-beam radiation is produced from an electron-beam source having the power of between 3 MeV to 5 MeV to provide a dosage of between about 4 to 25 gigarads for a period of about 15 to 500 hours.

5. The method of claim 1 wherein the rate of oscillation for said oscillating means is from about 5 to about 20 feet per minutes.

6. The method of claim 1 wherein said cooling means is a fluid.

7. The method claim 6 wherein said fluid is water.

8. A method for E-beam irradiation of topaz stones for color enhancement comprising the steps of:

placing the topaz stones in an oscillating means provided with coolant means;

circulating a coolant through said coolant means;

initiating an oscillating motion along a horizontal y-axis in said oscillating means;

directing an oscillating electron-beam produced by an electron-beam source have the power of 50 kW at between about 3 MeV to 5 MeV to provide a dosage of between 4 to 25 girarads for a period of about 24 hours onto the topaz stones and wherein the oscillating electron beam is along a z-axis;

maintaining the circulation of coolant through said coolant means until the topaz stones are cooled to ambient temperatures; and removing uniformly colored topaz stones.

* * * * *